US008039083B2

(12) United States Patent
Higashinaka et al.

(10) Patent No.: US 8,039,083 B2
(45) Date of Patent: Oct. 18, 2011

(54) HOOK-AND-LOOP FASTENER MADE OF FABRIC

(75) Inventors: Yukitoshi Higashinaka, Sakai (JP); Hitoshi Nakatsuka, Osaka (JP); Toshiyuki Katsuki, Sakai (JP); Kazuhiko Tanaka, Osaka (JP); Hiroshi Itoh, Sakai (JP)

(73) Assignee: Kuraray Fastening Co., Ltd., Osaka-shi (JP)

( * ) Notice: Subject to any disclaimer, the term of this patent is extended or adjusted under 35 U.S.C. 154(b) by 382 days.

(21) Appl. No.: 11/569,833

(22) PCT Filed: Jun. 9, 2005

(86) PCT No.: PCT/JP2005/010553

§ 371 (c)(1),
(2), (4) Date: Nov. 30, 2006

(87) PCT Pub. No.: WO2005/122817

PCT Pub. Date: Dec. 29, 2005

(65) Prior Publication Data

US 2008/0289157 A1 Nov. 27, 2008

(30) Foreign Application Priority Data

Jun. 17, 2004 (JP) ..... 2004-179099

(51) Int. Cl.
*A44B 18/00* (2006.01)
*D03D 27/04* (2006.01)
*D03D 1/00* (2006.01)

(52) U.S. Cl. ..... 428/99; 428/96; 428/97; 28/161; 26/2 R; 24/445

(58) Field of Classification Search ..... 428/99, 428/100, 92, 96, 97; 26/2 R, 18.5; 139/2, 139/391; 28/161; 24/442, 445, 447, 448
See application file for complete search history.

(56) References Cited

U.S. PATENT DOCUMENTS

| | | | | |
|---|---|---|---|---|
| 3,534,780 | A * | 10/1970 | Hockmeyer et al. | 139/391 |
| 4,910,062 | A * | 3/1990 | Zinke et al. | 428/95 |
| 4,920,617 | A * | 5/1990 | Higashinaka | 24/442 |
| 5,231,738 | A * | 8/1993 | Higashinaka | 24/446 |
| 5,349,991 | A * | 9/1994 | Okawa et al. | 139/391 |
| 5,369,852 | A * | 12/1994 | Higashinaka | 24/446 |
| 5,654,067 | A * | 8/1997 | Dinger et al. | 428/95 |
| 5,659,930 | A * | 8/1997 | Okawa | 24/445 |
| 5,996,673 | A * | 12/1999 | Iban et al. | 160/348 |
| 6,095,198 | A * | 8/2000 | Debaes | 139/398 |
| 6,202,264 | B1 * | 3/2001 | Ishihara | 24/445 |
| 6,221,158 | B1 * | 4/2001 | Kondo | 118/258 |
| 6,301,755 | B1 * | 10/2001 | Gaber | 24/450 |
| 6,386,242 | B1 * | 5/2002 | Higashinaka et al. | 139/391 |
| 6,443,187 | B1 * | 9/2002 | Wang et al. | 139/391 |
| 6,477,750 | B2 * | 11/2002 | Okawa et al. | 24/445 |
| 6,537,640 | B1 * | 3/2003 | Nakamura et al. | 428/92 |
| 6,546,603 | B1 * | 4/2003 | Wang et al. | 24/451 |
| 6,565,943 | B1 * | 5/2003 | Kondo et al. | 428/100 |
| 6,728,998 | B2 * | 5/2004 | Wang et al. | 24/451 |
| 7,193,010 | B2 * | 3/2007 | Kato et al. | 524/591 |
| 7,207,195 | B2 * | 4/2007 | Okawa | 66/193 |
| 7,387,975 | B2 * | 6/2008 | Okawa | 442/239 |
| 2001/0016972 | A1 * | 8/2001 | Okawa et al. | 24/445 |
| 2001/0035225 | A1 * | 11/2001 | Okawa | 139/383 R |
| 2005/0081341 | A1 * | 4/2005 | McDougall et al. | 24/445 |
| 2010/0043183 | A1 * | 2/2010 | Higashinaka et al. | 24/452 |

FOREIGN PATENT DOCUMENTS

| | | | |
|---|---|---|---|
| JP | 1 250434 | | 10/1989 |
| JP | 5 115312 | | 5/1993 |
| JP | 8 280418 | | 10/1996 |
| JP | 11 244010 | | 9/1999 |
| JP | 2001 238708 | | 9/2001 |
| WO | WO 2004105537 | A1 * | 12/2004 |

* cited by examiner

*Primary Examiner* — Cheryl Juska
(74) *Attorney, Agent, or Firm* — Oblon, Spivak, McClelland, Maier & Neustadt, L.L.P.

(57) ABSTRACT

A fabric separable fastener member is provided which comprises a fiber for a base fabric and a fiber for a fastening element firmly anchored by the fused fiber for the base fabric and which is excellent in flexibility and durability without a back-coated layer.

The separable fastener member comprises (α1) a ground warp, (α2) a ground weft containing a binder fiber, and (α3) a pile yarn, and the pile yarn (α3) is anchored by the fused binder fiber. In the separable fastener member, each of the ground warp (α1), the ground weft (α2) and the pile yarn (α3) comprises a polyester fiber, the mass ratio of the ground warp (a1) relative to the ground weft (a2) is 40/60 to 80/20, and the mass ratio of the total amount of the ground warp (a1) and the ground weft (a2) relative to the pile yarn (a3) is 90/10 to 50/50.

10 Claims, No Drawings

HOOK-AND-LOOP FASTENER MADE OF FABRIC

TECHNICAL FIELD

The present invention relates to a separable fastener member; and more specifically to a fabric separable fastener member comprising a fiber for a base fabric and a fiber for a fastening element, in which the fiber for the fastening element is firmly anchored (fixed) to the fused fiber for the base fabric by shrinkage of the fibers; as well as a production process thereof.

BACKGROUND ART

As a fabric separable fastener member, there has been widely used a separable fastener member in which a hook or loop fastening element (hereinafter sometimes simply referred to as a fastening element) is risen from a surface of a woven or knitted base fabric. In usual, such a fabric separable fastener member is, in view of strength, elasticity, or a recovering property from deformation, produced mainly by weaving or knitting a polyamide or polyester fiber as the fiber for the base fabric and for the fastening element. In the case where the fiber constituting the fastening element is not appropriately anchored to the base fabric, the fabric separable fastener member cannot exploit a desired property.

In order to dissolve the above problem, in practical cases, the fabric separable fastener member is provided with an adhesive layer (or back-coated layer) on the surface where the fastening element does not rise, i.e., on the backside (back surface) of the separable fastener member, to anchor the base fabric fiber and the fastening element fiber together. The adhesive layer (or back-coated layer) is producible from a variety of adhesive agents called a back-coating agent, and is typically a urethane layer.

However, the conventional separable fastener member provided with the adhesive layer has a drawback that the fastener member deteriorates in hand touchiness because of inflexibility thereof. Further, deterioration of the adhesive agent caused by usage such as washing or ironing gradually decreases anchoring ability (fixability) of fibers, resulting in degradation of the engaging function of the fastener member.

Moreover, the fabric separable fastener member is often dyed in a desired color for usage depending on application. However, in the fabric separable fastener member on which a conventional polyurethane back-coating agent is applied, due to hard dyeing property of the polyurethane, even if a disperse dye is used for dyeing, the separable fastener member is low in the color fastness and releases the dyestuff to stain other fiber products. Accordingly, there has been widely produced a separable fastener member which is fabricated by dyeing only a polyamide or polyester fiber which takes a dye well, subsequently applying a polyurethane back-coating agent to the dyed fiber to form a polyurethane layer without dyeing the polyurethane layer. However, such a production process takes many or long steps for obtaining a separable fastener member having a desired color, and low in productivity (efficiency in product supply). Consequently, a separable fastener member without the adhesive layer is proposed.

For example, Japanese Patent Application Laid Open No. 250434/1989 (JP-01-250434) (Patent document 1) discloses a sheet material for a separable fastener, which comprises a backing material partially containing a bonding yarn and a pile yarn knitted into the backing material. In the sheet material, the bonding yarn comprises a thermoplastic binding material having a low melting point and fuses to anchor fibers (yarns) with each other. In the document, the bonding yarn includes a combined filament yarn in which a multifilament yarn made of a high-melting component and a monofilament yarn made of a low-melting component are doubled, or a sheath-core structure conjugated fiber which comprises a low-melting component as a sheath component. More concretely, as the bonding yarn, there is used a doubling and twisting yarn comprising a polyamide or polyester monofilament having a low melting point and a polyamide or polyester multifilament having a high melting point, or a yarn comprising a high-melting polyester multifilament and a low-melting ethylene-vinyl acetate copolymer surrounding around or filling inside of the multifilament. Moreover, as the pile yarn, there is used a mono- or multifilament made of a polyamide 66, a monofilament made of a polypropylene.

Moreover, Japanese Patent Application Laid Open No. 115312/1993 (JP-05-115312) (Patent document 2) discloses a fabric separable fastener member comprising a ground part (a base fabric) comprising a sheath-core structure conjugated fiber, in which the conjugated fiber comprises a low-melting polymer as the sheath component and the low melting polymer of the conjugated fiber fuses and anchors the fibers together. The document describes that the sheath-core structure conjugated fiber includes a conjugated fiber which comprises a low-melting polyester copolymer as the sheath component, and a high-melting polyester or polyamide 6 as the core component. Further, as the pile yarn, a polyamide 6 filament is concretely employed, and a loop part (element) of the separable fastener member is formed by raising the pile yarn.

However, in these separable fastener members, although the bonding fibers (binder fibers) fuse and anchor the pile fibers forming a fastening element of the separable fastener member in a certain degree, anchoring (fixation) of the pile fibers to the base fabric fibers is insufficient, and the separable fastener member cannot resist to usage for a long period.

Patent document 1: JP-01-250434 (Claims 1 and 2, and Examples)

Patent document 2: JP-05-115312 (Claim 1 and Examples)

DISCLOSURE OF THE INVENTION

Problems to be Solved by the Invention

It is an object of the present invention to provide a fabric separable fastener member having a high productivity and a stability with maintaining an engaging function even after using for a long period.

It is another object of the present invention to provide a fabric separable fastener member excellent in flexibility, durability and dye-affinity without having a back-coated layer.

It is still other object of the present invention to produce a fabric separable fastener member excellent in flexibility, durability and dye-affinity in a simple manner.

Means to Solve the Problems

The inventors of the present invention made intensive studies to dissolve the above purposes, and finally found that firm anchoring of a pile yarn constituting a separable fastener member requires not only fusing of a binder fiber but also appropriate heat-shrinkage of fibers constituting a base (or a ground) of the separable fastener member, and that an excellent base-fused separable fastener member is produced by combining heat-shrinkage of the base and fusing of the binder fibers. The present invention was accomplished based on the above findings.

That is, the separable fastener member of the present invention is a separable fastener member which comprises (α1) a ground warp, (α2) aground weft containing a binder fiber, and (α3) a pile yarn, wherein the pile yarn (α3) is anchored by the fused binder fiber, and the separable fastener member fulfills the following conditions (i) to (iv):

(i) each of the ground warp (α1), the ground weft (α2) and the pile yarn (α3) comprises a polyester fiber, and the proportion (mass ratio) of the ground warp (α1) relative to the ground weft (α2) (α1/α2) is 40/60 to 80/20, and the proportion (mass ratio) of the total amount of the ground warp (α1) and the ground weft (α2) relative to the pile yarn (α3) [(α1+α2)/α3] is 90/10 to 50/50, (ii) the distance (L) between adjacent anchored points of the pile yarn (α3) is 0.3 to 0.7 mm, (iii) the void space in a unit area defined by a pair of ground warps (α1) and a pair of ground wefts (α2) both of which are adjacent to the pile yarn (α3) is 0 to 100 $\mu m^2$, and the pile drawing out strength is not less than 1 kg per yarn, and (iv) the cover factor (K1) of the ground warp (α1) and the cover factor (K2) of the ground weft (α2) fulfill the following formulae.

$$28 \leqq K1 \leqq 38$$

$$10 \leqq K2 \leqq 18$$

$$1.56 \leqq (K1/K2) \leqq 3.8$$

In the separable fastener member, each of the ground warp (α1), the ground weft (α2) and the pile yarn (α3) may comprise an aromatic polyester fiber, and the binder fiber contained in the ground weft (α2) may comprise an amorphous (non-crystalline) polyester fiber. Further, the binder fiber constituting the ground weft (α2) may be a sheath-core structure conjugated fiber which comprises a polyester having a melting point of not lower than 160° C. as the core component and an amorphous polyester resin as the sheath component, wherein the proportion (mass ratio) of the core relative to the sheath (core/sheath) in the conjugated fiber may be about 75/25 to 30/70.

The present invention also includes a process for producing the separable fastener member, comprises providing a woven fabric (pile woven fabric) formed from a ground warp (α1), a ground weft (α2) and a pile yarn (α3), and heat-treating the woven fabric to fuse the ground weft (α2) containing a binder fiber and to anchor the pile yarn (α3) in the woven fabric, wherein each of the ground warp (α1), the ground weft (α2) and the pile yarn (α3) satisfies the following conditions (1) and (2).

(1) Peak thermal stress of α10≧0.07 cN/dtex

Peak thermal stress of α2≧0.20 cN/dtex

Peak thermal stress of α3≧0.10 cN/dtex (2) 4%≦Dry heat shrinkage of α1 at 180° C.≦20%

13%≦Dry heat shrinkage of α2 at 180° C.≦30%

10%≦Dry heat shrinkage of α3 at 180° C.≦30%

In the production process, the ratio of the peak thermal stress of the ground warp (α1) relative to the ground weft (α2) [(peak thermal stress of α1)/(peak thermal stress of α2)] may be about 1/0.5 to 1/5, and the ratio of the peak thermal stress of the pile yarn (α3) relative to the ground weft (α2) [(peak thermal stress of α3)/(peak thermal stress of α2)] may be about 1/0.5 to 1/4, the ratio of the dry heat shrinkage at 180° C. of the ground warp (α1) relative to the ground weft (α2) [(dry heat shrinkage of α1)/(dry heat shrinkage of α2)] may be about 1/0.5 to 1/7, and the ratio of the dry heat shrinkage of the pile yarn (α3) relative to the ground weft (α2) at 180° C. [(dry heat shrinkage of α3 at 180° C.)/(dry heat shrinkage of α2 at 180° C.)] may be about 1/0.5 to 1/5.

Effects of the Invention

The separable fastener member of the present invention has high productivity and is stable even after a long-term use. Further, the separable fastener member is excellent in flexibility, durability, and/or dye-affinity even without abackcoated layer (back-coating agent). Furthermore, according to the present invention, such an excellent separable fastener member is producible in a simple manner.

That is, in the present invention, since the ground weft of the base fabric is shrinked and fused, the shrinked and fused ground weft anchors both the fiber of the ground warp and the fiber of the pile yarn. Thereby the separable fastener member of the present invention is producible substantially free from a back-coating agent, and can be dyed at almost the last step of the production process or after finishing the production process. Accordingly, a small amount of separable fastener members (separable fastener) can be easily dyed in a variety of colors.

Moreover, in the separable fastener member of the present invention, the yarns of the base fabric and the pile yarn comprise specific fiber materials which are the same species or same series with each other, and the base fabric is adjusted to have a specific weaving density. Thereby the separable fastener member has an engaging element drawing out strength of not less than 1 kg per yarn, shows a good dyeing property, and excels in hand touchiness (or feel).

Further, since the separable fastener member of the present invention comprises a single material, not only thermal recycle but also material recycle are achieved in the disposal of the wasted separable fastener member.

DETAILED DESCRIPTION OF THE INVENTION

The separable fastener member of the present invention is a fabric separable fastener member which comprises a woven base fabric and a hook or loop fastening element. More specifically, the fabric separable fastener member comprises (α1) a ground warp, (α2) a ground weft containing a binder fiber, and (α3) a pile yarn.

[Ground Warp (α1)]

In the present invention, in terms of mechanical properties (e.g., strength, elasticity, and recovering property from deformation) or flexibility, a polyester fiber is used as the fiber constituting the ground warp (α1). The polyester resin constituting the polyester fiber may include an aromatic polyester resin and an aliphatic polyester resin. As the fiber, from the viewpoint of mechanical properties, the preferred one comprises an aromatic polyester resin. The aromatic polyester resin may be a homo- or copolyester obtained by a condensation polymerization of an aromatic dicarboxylic acid (e.g., terephthalic acid, isophthalic acid, phthalic acid and 2,6-naphthalenedicarboxylic acid) and a diol component (e.g., ethylene glycol, propylene glycol, trimethylene glycol, butylene glycol and 1,4-cyclohexane dimethanol). Concrete examples of the aromatic polyester resin may include a poly$C_{2-6}$alkylene acrylate such as a polyethylene terephthalate, a polypropylene terephthalate, a poly(trimethylene terephthalate), a polybutylene terephthalate, or a polyethylene naphthalate; a poly1,4-cyclohexanedimethylene terephthalate; and others. These aromatic polyester resins may be used singly or in combination. Among these polyester resins, a poly$C_{2-4}$alkylene terephthalate such as a polyethylene terephthalate is generally used.

Incidentally, the ground warp (α1) may contain a binder fiber after-exemplified in the item of the ground weft (α2). In view of significant unchangeability of the property of the base fabric, the binder fiber is desirably used only in the ground weft (α2) of the base fabric.

The ground warp (α1) usually comprises a continuous fiber (so-called "filament yarn" or "filament"). The filament yarn may be a monofilament yarn, and from the viewpoint of the flexibility of the base fabric, is preferably a multifilament yarn. The fineness of the ground warp (α1) (in the case of the multifilament yarn, the fineness of the multifilament yarn) is, for example, about 100 to 400 dtex, preferably about 110 to 350 dtex, and more preferably about 120 to 300 dtex (particularly about 130 to 200 dtex). The single fiber fineness of the multifilament is not limited to a specific one, and is, for example, about 1 to 20 dtex, preferably about 1.5 to 15 dtex, and more preferably about 2 to 10 dtex. The number of filaments constituting the multifilament is, for example, about 10 to 100, preferably about 20 to 70, and more preferably about 30 to 50.

Further, in the present invention, each yarn used in the base fabric has specific values with respect to the peak thermal stress (peak value of thermal stress) and the dry heat shrinkage (shrinkage under dry heat or dry air). The peak thermal stress of the ground warp (α1) is, for example, not less than 0.07 cN/dtex, preferably about 0.07 to 0.5 cN/dtex, and more preferably about 0.07 to 0.2 cN/dtex (particularly about 0.075 to 0.15 cN/dtex). The peak thermal stress acts as a shrinking and anchoring (fixing) power (property) between yarns in the woven base fabric, and too small peak thermal stress lowers the shrinking and anchoring power between yarns.

The dry heat shrinkage (shrinkage under dry heat or dry air) of the ground warp (α1) at 180° C. is, for example, about 4 to 20%, preferably about 5 to 18%, and more preferably about 5 to 15%. In the case of weaving the ground warp (α1) as the base fabric, the dry heat shrinkage depends on the peak thermal stress. Too small dry heat shrinkage contributes to coarse structure of the base fabric due to slight shrinkage. Accordingly, the base fabric has trouble for anchoring the fastening element. On the contrary, regardless of large shrinkage, too large dry heat shrinkage lowers dimensional stability of the base fabric.

In the present invention, the peak thermal stress (peak value of thermal stress) is a value determined as the maximum shrinkage stress in the thermal stress curve obtained by elevating a temperature to 300° C. over 180 seconds with the use of a thermal stress measuring instrument (manufactured by Kanebo Engineering, Ltd., MODEL KE-2S). Moreover, the dry heat shrinkage is a value determined in accordance with JIS (Japanese Industrial Standards) L 1013.

[Ground Weft (α2)]

The ground weft (α2) comprises at least a binder fiber. The fiber constituting the ground weft also comprises a polyester resin from the viewpoint of improvement in the adhesiveness between fibers and of the thermal and material recyclability. Such a polyester resin may include, for example, polyester resins exemplified in the item of the ground warp (α1).

The binder fiber is not limited to a specific one, as far as the binder fiber comprises a heat-fusing (heat-fusible) polyester resin (e.g., a polyester resin having a lower melting point than the polyester resin of the ground warp or the pile yarn), and an amorphous (non-crystalline) polyester resin is preferred. The amorphous polyester resin may include a copolyester containing an alkylene acrylate unit as the main component, particularly preferably a copolyester containing a $C_{2-6}$alkylene acrylate unit (e.g., a $C_{2-4}$alkylene terephthalate unit) as the main component, and other copolymerizable component. As the other copolymerizable component, there may be mentioned, for example, a poly$C_{2-4}$alkylene glycol, an aliphatic dicarboxylic acid having 6 to 12 carbon atoms, and an asymmetric aromatic dicarboxylic acid. Among these components, the asymmetric aromatic dicarboxylic acid such as isophthalic acid or phthalic acid (particularly isophthalic acid) is preferred. The proportion of the other copolymerizable component in the corresponding monomer components (for example, in the case of using a dicarboxylic acid component as the other copolymerizable component, in the total dicarboxylic acid components) is, for example, about 15 to 60% by mole, preferably about 20 to 50% by mole, and more preferably about 20 to 40% by mole. As the amorphous polyester, specifically, an isophthalic acid-modified poly$C_{2-4}$alkylene terephthalate such as an isophthalic acid-modified polyethylene terephthalate is generally used in terms of physical property of fibers, quality, productivity in the process for producing the fiber, reductions in cost, and the like.

The binder fiber may be a fiber containing a thermal adhesive component in part, for example, a sheath-core structure conjugated fiber (particularly a sheath-core structure conjugated fiber containing an amorphous polyester as the sheath component). In such a sheath-core structure conjugated fiber, in the case where the sheath component comprises the amorphous polyester resin (particularly a poly$C_{2-4}$alkylene terephthalate resin which is modified with an asymmetric aromatic dicarboxylic acid such as isophthalic acid), it is preferred to use, as the core component, a polyester having a melting point of not lower than 160° C. (e.g., about 160 to 300° C.). As the polyester having a melting point of not lower than 160° C., the preferred one includes a poly$C_{2-6}$alkylene acrylate resin such as a polyethylene terephthalate or a polybutylene terephthalate (particularly a poly$C_{2-4}$alkylene terephthalate resin).

In the sheath-core structure conjugated fiber, the proportion (mass ratio) of the core relative to the sheath (core/sheath ratio) may be selected from the range of, for example, about 90/10 to 20/80, and is for example, about 80/20 to 30/70, preferably about 75/25 to 30/70, and more preferably about 75/25 to 50/50. Too large proportion of the core part contributes to less fusing (welding) of the conjugated fiber, thereby anchoring of the base fabric is liable to be insufficient. On the contrary, too small proportion of the core part causes much fusing (welding) of the conjugated fiber, thereby flexibility of the base fabric is deteriorated. Further, the base fabric is liable to be torn.

In the case of using the sheath-core structure conjugated fiber as the binder fiber, the sheath component works as the fusing component and the core component maintains a fiber shape thereof. Accordingly, even if the separable fastener member is subjected to fusing treatment, the separable fastener member is small in weight loss of the conjugated fiber and in deformation such as shrinkage. Therefore, use of the sheath-core structure conjugated fiber ensures to inhibit deformation of the separable fastener member as well as lowering of the strength thereof.

In usual, the ground weft (α2) also comprises a continuous fiber (so-called filament yarn or filament). The filament yarn of the ground weft (α2) may be a monofilament yarn, and in view of the flexibility of the base fabric or others, is preferably a multifilament yarn. The multifilament yarn may be a multifilament yarn comprising a binder fiber alone, or a combined filament yarn comprising a binder fiber and other fiber(s) (e.g., a fiber similar to the ground warp). Incidentally, even in using a combined filament yarn containing a binder fiber and other fiber(s) as the ground weft (α2), the same or similar effect with the sheath-core structure conjugated fiber can be achieved by adjusting the proportion of the binder fiber relative to other fiber(s). In the fusing process of the binder fiber, the other fiber(s) can remain and the remaining fiber(s) contributes to small transformation (deformation) of the fiber entirety.

The fineness of the ground weft (α2) (in the case of the multifilament yarn, the fineness of the multifilament yarn) is, for example, about 100 to 500 dtex, preferably about 150 to 400 dtex, and more preferably about 200 to 400 dtex (particularly about 250 to 350 dtex). The single fiber fineness of the multifilament may be the same degree with the fiber used in the conventional separable fastener member, and is, for example, about 1 to 20 dtex, preferably about 1.5 to 15 dtex, and more preferably about 2 to 10 dtex. The number of filaments constituting the multifilament is, for example, about 10 to 200, preferably about 30 to 150, and more preferably about 50 to 120.

The peak thermal stress of the ground weft (α2) is, for example, not less than 0.2 cN/dtex, preferably about 0.2 to 1 cN/dtex, and more preferably about 0.2 to 0.5 cN/dtex (particularly about 0.2 to 0.4 cN/dtex). Too small peak thermal stress lowers the shrinking and anchoring power between yarns.

In the present invention, it is preferred that the ratio of the peak thermal stress of the ground warp (α1) relative to the peak thermal stress of the ground weft (α2) is in a specific range. The ratio of the peak thermal stress of the ground warp (α1) relative to the peak thermal stress of the ground weft (α2) [(peak thermal stress of α1)/(peak thermal stress of α2)] is, for example, about 1/0.5 to 1/5, preferably about 1/0.7 to 1/5, and more preferably about 1/1 to 1/4.5.

The dry heat shrinkage of the ground weft (α2) at 180° C. is, for example, about 13 to 30%, preferably about 14 to 30%, and more preferably about 15 to 30%. In the case of weaving the ground weft (α2) as the base fabric, the dry heat shrinkage depends on the peak thermal stress. In the case where thermal stress value of the ground weft is small, too small dry heat shrinkage contributes to slight shrinkage of the base fabric, resulting in difficulty of homogeneous anchoring (at regular intervals) of the fastening element by the fused binder fiber. On the contrary, regardless of large shrinkage, too large dry heat shrinkage lowers dimensional stability of the base fabric.

It is also preferred that the ratio of the dry heat shrinkage of the ground warp (α1) at 180° C. relative to the dry heat shrinkage of the ground weft (α2) at 180° C. is in a specific range. The ratio of the dry heat shrinkage of the ground warp (α1) at 180° C. relative to the dry heat shrinkage of the ground weft (α2) at 180° C. [dry heat shrinkage of α1/dry heat shrinkage of α2] is, for example, about 1/0.5 to 1/7, preferably about 1/0.7 to 1/6, and more preferably about 1/1 to 1/5. The above ratio between the two realizes improvement in the flexibility and durability of the fabric because of homogeneously fusing and anchoring of the ground warp (α1) and the ground weft (α2) with each other.

The proportion (mass ratio) of the ground warp (α1) relative to the ground weft (α2) [α1/α2] is, for example, about 40/60 to 80/20, preferably about 45/55 to 75/25, and more preferably about 50/50 to 70/30. In the case where the proportion of the ground warp (α1) is too small, the anchoring of the pile yarn becomes unstable, and flexibility of the base fabric is lowered due to too much fusing property of the ground weft (α2). On the contrary, too much proportion of the ground warp (α1) causes difficulty in weaving as well as lowering in anchoring of the pile yarn due to declining fusing property of the ground weft (α2).

[Pile Yarn (α3)]

The pile yarn (α3) forms a loop (part) or a hook (part) in the separable fastener member, and is used as a loop or hook fastening element. The pile yarn (α3) is attached to the ground weft (α2) and anchored in the base fabric by the fused binder fiber constituting the ground weft (α2).

As the fiber constituting the pile yarn (α3), a polyester fiber(s) exemplified in the item of the ground warp (α1) may be also used in view of adhesiveness between fibers, as well as improvement in thermal and material recyclability. Among these fibers, the pile yarn (α3) also preferably comprises a polyester fiber which is the same species or same series with at least the ground weft (α2) particularly with both the ground warp (α1) and the ground weft (α2) in view of improvement in adhesiveness between fibers. That is, the fiber constituting the pile yarn (α3) preferably comprises a polyester fiber, particularly an aromatic polyester fiber (e.g., a poly$C_{2-4}$alkylene terephthalate such as a polyethylene terephthalate).

The pile yarn may be a monofilament yarn or a multifilament yarn. The pile yarn forming a hook usually comprises a monofilament yarn in terms of maintaining the engagement strength, and the pile yarn forming a loop usually comprises a multifilament yarn.

In the case where the pile yarn (α3) is used as the hook fastening element, the fineness of the pile yarn (α3) is, in terms of the fineness of the monofilament, for example, about 100 to 500 dtex, preferably about 150 to 500 dtex, and more preferably about 200 to 450 dtex (particularly about 250 to 400 dtex). In the case where the pile yarn (α3) is used as the loop fastening element, the fineness of the pile yarn (3) is, in terms of the fineness of the multifilament, for example, about 150 to 350 dtex, preferably about 170 to 320 dtex, and more preferably about 200 to 300 dtex (particularly about 230 to 300 dtex). In the pile yarn used as the loop fastening element, the number of filaments constituting the multifilament is, for example, about 5 to 20, preferably about 6 to 18, and more preferably about 7 to 15.

The peak thermal stress of the pile yarn (α3) is, for example, not less than 0.1 cN/dtex, preferably about 0.1 to 0.5 cN/dtex, and more preferably about 0.1 to 0.2 cN/dtex. Too small peak thermal stress lowers the shrinking and anchoring power between yarns.

In the present invention, the ratio of the peak thermal stress of the pile yarn (α3) relative to the peak thermal stress of the ground weft (α2) [(peak thermal stress of α3)/(peak thermal stress of α2)] is, for example, about 1/0.5 to 1/4, preferably about 1/0.7 to 1/3.5, and more preferably about 1/1 to 1/3.

The dry heat shrinkage of the pile yarn (α3) at 180° C. is, for example, about 10 to 30%, preferably about 10 to 25%, and more preferably about 15 to 25%. In the case where thermal stress value of the pile yarn is small, too small dry heat shrinkage causes slight shrinkage of the pile yarn in weaving to the base fabric, resulting in difficulty of homogeneous anchoring of the pile yarn by the fused binder fiber. On the contrary, too large dry heat shrinkage lowers dimensional stability of the pile yarn, resulting in uneven loop or hook shape.

The ratio of the dry heat shrinkage at 180° C. of the pile yarn (α3) relative to the ground weft (α2) [(dry heat shrinkage of α3)/(dry heat shrinkage of α2)] is, for example, about 1/0.5 to 1/5, preferably about 1/0.6 to 1/4, and more preferably about 1/0.7 to 1/3 (particularly about 1/0.8 to 1/2). The above ratio between the two realizes a separable fastener member in which shedding (or dropping-out of loops or hooks) is inhibited because the pile yarn (α3) is homogeneously anchored to the base fabric by the fused ground weft (α2). In particular, in the case where all of the ground warp (α1), the ground weft (α2) and the pile yarn (α3) comprise a fiber comprising the same species or same series resin with one another (particularly a polyester fiber), and a polyester binder fiber having a specific dry heat shrinkage relative to the ground warp (α1) and the pile yarn (α3) is used as the ground weft (α2); is obtainable a fabric separable fastener member in which the base fabric has a flexibility and which is excellent in anchoring of the fastening element by the fused binder fiber.

The proportion (mass ratio) of the total amount of the ground warp (α1) and the ground weft (α2) relative to the pile yarn (α3) [(α1+α2)/α3] is, for example, about 90/10 to 50/50, preferably about 85/15 to 55/45, and more preferably about 80/20 to 60/40. Too small proportion of the pile yarn (α3) causes lowering of the engagement strength, and too large proportion of the pile yarn (α3) contributes to the coarse base fabric density, resulting in difficulty in anchoring of the fastening element.

Further, the mass ratio of the fiber constituting the separable fastener member may be in a range of about 30 to 50% (particularly about 35 to 45%) as the ground warp (α1), about 20 to 40% (particularly about 20 to 35%) as the ground weft (α2), and about 10 to 50% (particularly about 20 to 40%) as the pile yarn (α3).

[Separable Fastener Member]

The separable fastener member of the present invention is a fabric separable fastener member obtainable by weaving the ground warp (α1), the ground weft (α2) containing a binder fiber, and the pile yarn (α3). More specifically, the separable fastener member of the present invention is a separable fastener member in which the ground warp (α1) and the ground weft (α2) constitute the base fabric and the pile yarn (α3) constitutes the fastening element formed in the base fabric.

Incidentally, as mentioned above, although it is known that the fusion of the base fabric is realized with the binder fiber (e.g., a low-melting polyester fiber, a low-melting polyamide fiber, and a polyolefinic fiber), the conventional binder fiber is insufficient in fusion with a constitutive fiber of the separable fastener member, or the separable fastener member comprising the conventional binder fiber does not reach a practical level because of too strong hardening of the base fabric. Therefore, there has not been known a fabric separable fastener member which is excellent in flexibility of the base fabric as well as in anchoring of the fastening element by the fused binding fiber.

The present inventors carefully examined the fusing property of a ground weft containing a binder fiber (hereinafter sometimes referred to as a binder fiber) to the pile yarn, and finally found that the fused binder fiber does not flow into the entire surface of the pile yarn in the fused area, but fuses together with the pile yarn only at areas of contact, even if using a sufficient amount of the binder fiber and heating the binder fiber at a temperature of not lower than the melting point thereof. It is thought that the above phenomenon is caused because of the following reasons: even if the binder resin is molten, the molten binder resin is low in flowability due to high viscosity thereof, and the molten binder resin is flowed into part of the contact area of the pile yarn and adhered thereto. Therefore, in the conventional method, the adhesion of the pile yarn to the binder fiber is incomplete, and the pile yarn is liable to be dropped out either cases using hook-forming monofilament as well as loop-forming multifilament.

On the contrary, in the present invention, adjusting the distance (L) between adjacent anchored points of the pile yarn (α3) in the range of about 0.3 to 0.7 mm (particularly about 0.4 to 0.65 mm) ensures to give a separable fastener member which is superior in flexibility to a separable fastener member having a back-coated layer and in which the pile yarn is anchored by the fused binder fiber in the degree of not slip-out (missing). Further, the distance (L) for a hook fastening element is particularly preferred in a range of 0.45 to 0.65 mm, and the distance (L) for a loop fastening element is particularly preferred in a range of 0.4 to 0.6 mm. Too short distance (L) lowers flexibility of the separable fastener member due to many fusing points. Contrarily, too long distance (L) causes insufficient fusing of the binder fiber to the pile yarn, and the pile yarn is liable to be dropped out.

The distance (L) in the present invention is determined in the following manner. These parable fastener member is cut in the lengthwise direction of the pile yarn, and the cross section of the separable fastener member is observed with a microscope. On a micrograph thereof (e.g., ×50 micrograph), after deciding a left edge of a pair of adjacent anchored points of the pile yarn, the distance between the adjacent anchored points is measured. The measurement is conducted at 5 to 10 pairs, and the average value thereof is regarded as "L value" (distance (L)).

The L value of such a pile yarn can be settled as a desired value by adjusting the weaving structure of the ground yarns and the pile yarn, and/or the retention property (pile drawing out strength) of the pile yarn.

Moreover, according to the present invention, by adjusting a void space in a unit area defined by a pair of ground warps (α1) and a pair of ground wefts (α2) both of which are adjacent to the pile yarn (α3) [i.e., an area of the void space (of a unit area) which is determined by a pile yarn and a base fabric (ground warps and ground wefts) surrounding the pile yarn] to be 0 to 100 $\mu m^2$, is obtainable a fabric separable fastener member which excels in flexibility of the base fabric as well as anchoring property of the fastening element by the fused binder fiber. Such a void space in the unit area is preferably about 0 to 80 $\mu m^2$, and more preferably about 0 to 50 $\mu m^2$ (particularly about 0 to 30 $\mu m^2$). In the case where the void area is too large, the fusing and anchoring property of the binder fiber is deteriorated, as a result, the pile drawing out strength becomes small, and the separable fastener member cannot resist against repeated engagement-disengagement because of insufficient anchoring (or fixation) of the fastening element by the fused binder fiber. Such a void area is determined in the following manner. The bottom of a pile yarn (α3) is cut, then the void area in a unit area formed by a pair of ground warps (α1) and a pair of ground wefts (α2) adjacent to the pile yarn is measured on a 200× micrograph with a scanning electron microscope.

Further, the separable fastener member of the present invention needs to have a pile drawing out strength of not less than 1 kg per yarn. The pile drawing out strength is preferably about 1 to 10 kg per yarn, and more preferably about 1 to 5 kg per yarn. In the present invention, in the case where the pile yarn is a monofilament for hook, the monofilament drawing out strength is measured. In the case where the pile yarn is a multifilament yarn for loop, the multifilament drawing out strength is measured. Incidentally, in the present invention, the pile drawing out strength shows a resistance value for drawing out one loop (or hook) of the loop- or hook-shaped pile yarn from the base fabric which is subjected to heat treatment, and is measured as a maximum value thereof.

In the separable fastener member of the present invention, the cover factor which shows a crude density (weaving density) of the woven fabric is preferably in a specific range. That is, it is preferred that the cover factor (K1) of the ground warp (α1) is about 28 to 38 (particularly about 30 to 36), and that the cover factor (K2) of the ground weft (α2) is about 10 to 18 (particularly about 11 to 15). Too small cover factor (K1) of the ground warp brings about a coarse warp density, resulting in unstable anchoring of the pile yarn. Too large cover factor (K1) of the ground warp contributes to a dense warp density, resulting in difficulty in weaving. Moreover, too small cover factor (K2) of the ground weft causes a coarse weft density, resulting in unstable anchoring of the warp yarn and the pile yarn. Too large cover factor (K2) of the ground weft causes a dense weft density, resulting in difficulty in weaving.

Further, the ratio of the cover factor (K1) relative to the cover factor (K2) (K1/K2) is, for example, about 1.56 to 3.8, and preferably about 2 to 3.5. In the case where the ratio K1/K2 is too small, the ground warp density becomes larger (coarser) than the ground weft density, and anchoring of the pile yarn becomes unstable. As a result, the fastening element density also becomes large (coarse), and the peel strength of the engaged separable fastener becomes small. Contrarily, in the case where the ratio K1/K2 is too large, the ground weft density becomes denser than the ground weft density, and resulting in difficulty in weaving, further the operating efficiency of the weaving machine also deteriorates.

In the present invention, the cover factor (K) is calculated from the product of the fabric density (number of yarns per inch) by square root of yarn fineness, that is, the cover factor (K) is calculated from the following formula.

$$K=1/72.9\times(\text{fabric density after process})\times[(\text{yarn fineness after process})/1.11]^{1/2}$$

The basis weight (mass per unit area) of the separable fastener member of the present invention can be selected from the range of, for example, about 100 to 500 g/m$^2$, and is preferably about 150 to 400 g/m$^2$, and more preferably about 200 to 400 g/m$^2$.

In the separable fastener member of the present invention, the shape of the fastening element (or part) comprising a pile yarn is not limited to a specific one, as far as the fastening element rises from the base fabric and can function as a separable fastener by engagement of the fastening elements. The loop fastening element (loop) usually has a ring-like or circular shape, and the hook fastening element (hook) usually has a crook-like shape (e.g., a notched ring-like shape which is formed by cutting a loop) or a swollen head-like shape (e.g., a shape in which a yarn has a mushroom-shaped head), and the like. The loop density on the base fabric is, for example, about 10 to 100 per cm$^2$, preferably about 20 to 80 per cm$^2$, and more preferably about 30 to 60 per cm$^2$. The hook density on the base fabric is, for example, about 20 to 200 per cm$^2$, preferably about 40 to 160 per cm$^2$, and more preferably about 60 to 120 per cm$^2$. Each loop and hook has a height of, for example, about 1 to 5 mm, preferably about 1.3 to 4 mm, and more preferably about 1.5 to 3 mm.

The separable fastener member of the present invention may be a separable fastener member which comprises a base fabric provided with either hooks or loops on the entirety surface thereof, in addition, may be a so-called hook-and-loop coexisting fastener member which comprises a base fabric provided with hooks and loops which coexist together on the surface thereof. As the hook-and-loop coexisting fastener member, there may be mentioned, for example, a fastener member described in Japan Patent Laid Open No. 154009/1993 (JP-05-154009), and others.

The separable fastener member of the present invention may be further subjected to a secondary fabrication. For example, an adhesive agent or an agglutinant may be applied on the backside (back surface) of the separable fastener member to give a separable fastener member which is easily adherable (attachable) to an object. Moreover, since the separable fastener member of the present invention is excellent in dye-affinity, the separable fastener member may be dyed with a disperse dye, and others.

[Production Process of Separable Fastener Member]

The separable fastener member of the present invention is producible by weaving a ground warp ($\alpha$1), a ground weft ($\alpha$2) and a pile yarn ($\alpha$3) each of which has the above-mentioned peak thermal stress and dry heat shrinkage to form a woven fabric (textile), and heat-treating the woven fabric to fuse the ground weft ($\alpha$2) containing a binder fiber and to anchor the pile yarn ($\alpha$3) in the woven fabric.

The production process of the woven fabric comprising a ground warp ($\alpha$1), a ground weft ($\alpha$2) and a pile yarn ($\alpha$3) is not limited to a specific one, and can adopt (employ) a conventional weaving machine. In the present invention, the base (ground weave) is preferably a plain weave from the viewpoint of convenience.

The fastening element (or part) may be formed by weaving a pile yarn so as to have the fastening element (or part) risen from the base fabric. The loop may be formed by weaving a pile yarn in a conventional manner so as to have the loop risen from the base fabric. The hook also may be formed in a conventional manner. For example, a crook-shaped hook may be formed by cutting one side of a loop comprising a monofilament, or a mushroom-shaped hook may be formed by fusing a head of a pile yarn to make the head swollen. As the cutting method of the loop, there may be employed, for example, a method described in Japan Patent Laid Open No. 61713/2003 (JP-2003-61713), and others.

A separable fastener member (woven fabric) comprising a pile yarn which is rising on the surface thereof is dry- or wet-heat treated at an arbitrary step in the forming process of each fastening element or in the after-treatment (post-treatment) process, and by the heat treatment, the constituent fibers of the separable fastener member are thermally anchored. The temperature for heat treatment in the production process of the separable fastener member can be suitably selected, depending on the melting point of the binder fiber, from a temperature range which is higher than the melting point of the binder fiber and lower than the melting point of the other constitutive fiber(s). For example, in the case of using a polyester sheath-core structure binder fiber as the binder fiber, the heat treatment temperature is usually about 160 to 250° C. (particularly about 180 to 230° C.), and if necessary, the heat treatment is conducted in the presence of overheated steam (superheated vapor). As a result, the ground weft ($\alpha$2) having a specific dry heat shrinkage and containing a binder fiber is melted (or molten) and fused with the ground warp ($\alpha$1) constituting the base fabric of the separable fastener member as well as with the pile yarn ($\alpha$3) constituting the fastening element. In the present invention, according to fusing of the binder fiber, the step for applying an adhering agent (a back-coating agent) to the backside (back surface) of the base fabric of the separable fastener member is substantially omissible. The fusing treatment of the binder fiber may be independently conducted, or may be conducted at the same time with other heat treatment.

Further, the separable fastener member of the present invention may be a separable fastener member in which both a base fabric and a fastening element have almost equivalent hue (color) with each other. Such a separable fastener member is obtainable by means of dyeing of a produced (undyed) separable fastener member with a disperse dye in the usual manner, for example, at a temperature of about 100 to 150° C. (e.g., about 120 to 140° C.) and for about 10 minutes to 10 hours (e.g., about 30 minutes to 3 hours). Thus obtained separable fastener member does not have a trouble such as wrinkle or deformation. Moreover, the separable fastener member does not cause a migration of dye due to friction or discoloring with washing Incidentally, in the case where the dyeing temperature is higher than the temperature for thermally anchoring (the temperature of heat treatment) in the production process of the separable fastener member, performance of the separable fastener member is sometimes deteriorated because of change of the fiber elongation due to decrease of the anchoring effect by the fiber or because of deformation (displacement) of weaving structure. Therefore, it is preferred to dye the separable fastener member at a temperature lower than the temperature for thermally anchoring. Moreover, in the case where the pile yarn for the fastening element has not form a fastening element shape yet at the moment of heat treatment, the pile yarn for the fastening element may be transformed to a fastening element either after heat treatment or after dyeing treatment, by cutting the side of the pile yarn or fusing the top of the pile yarn to make a swollen head.

INDUSTRIAL APPLICABILITY

The separable fastener member of the present invention is useful for a fastener (separable fastener) applied in a variety of fields (application) such as a fabric such as a clothing, a curtain (a hanging, a drape or a drapery), a cloth (a cover cloth), a flag, a labarum, a rug (a foot cloth), or a carpet (a resilient flooring covering), a toy (a play thing), a commodity (an article of daily use), an electric (electrical) apparatus, a furniture, and others because the fastener member is easily adherable by sewing or with the use of an adhesive agent. In particular, since the separable fastener member has high flexibility and is excellent in dye-affinity, the separable fastener member is advantageously usable to a fabric such as a clothing or a curtain.

EXAMPLES

The following examples are intended to describe this invention in further detail and should by no means be interpreted as defining the scope of the invention. Incidentally, the % in the Examples stands on mass as far as there is described any specific notices.

Example 1

A separable fastener member was produced by using a polyethylene terephthalate fiber (167 dtex, number of filaments: 48 (48 f)) as a ground warp (α1) of abase fabric, a binder fiber (a sheath-core structure polyester fiber, the sheath component: a copolymerized polyethylene terephthalate modified with 25% by mole of isophthalic acid, the core component: a polyethylene terephthalate, the core/sheath ratio (by mass): 75/25, 334 dtex, 96 f) as a ground weft (α2) of the base fabric, and a polyethylene terephthalate fiber (390 dtex, 1 f) as a pile yarn (α3) for a hook; weaving the ground warp (α1), the ground weft (α2) and the pile yarn (α3) at a weft density of 42 per inch to form a woven fabric; heat-treating the woven fabric at a temperature of 185° C. for 1 minute; and cutting hook-forming loops of the pile yarn. The results are shown in Table 1. Incidentally, the peak thermal stresses and dry heat shrinkages of each of the ground warp, the ground weft and the pile yarn used are also shown in Table 1.

Thus obtained hook fastener member had a mass ratio of 38% of the ground warp, 27% of the ground weft, 35% of the pile yarn for hooks, and had five fused (or intersected) points of the ground weft with the pile yarn between loops of the adjacent pile yarns in the lengthwise direction of the fastener member. The distance (L) of the pile yarn was 0.523 mm. The weft density was 47 per inch, the warp density was 178 per inch, the cover factors K1 and K2 were 35.8 and 11.8, respectively, and the ratio K1/K2 was 3.03. Moreover, the void space in a unit area defined by ground warps and ground wefts was 10 $\mu m^2$, and the pile drawing out strength was 1.2 kg per yarn.

The peel test between the obtained hook fastener member and a loop fastener member (manufactured by Kuraray Fastening Co., Ltd., B27000) revealed that hooks were not dropped out even after 5000 repeated engagement-disengagement (in accordance with JIS L3416). Moreover, thus obtained separable fastener member was dyed in a conventional method with a disperse dye at 130° C. for 1 hour. The dyed separable fastener member did not have any hue difference and had a uniform appearance in hue, and also was not deformed. The result of the peel test (durability) is shown in Table 1.

Example 2

A separable fastener member of the present invention was produced by using a polyethylene terephthalate fiber (167 dtex, 48 f) as a ground warp (α1) of a base fabric, a binder fiber (a sheath-core structure polyester fiber, the sheath component: a copolymerized polyethylene terephthalate modified with 25% by mole of isophthalic acid, the core component: a polyethylene terephthalate, the core/sheath ratio (by mass): 70/30, 334 dtex, 96 f) as a ground weft (α2) of the base fabric, and a polyethylene terephthalate fiber (264 dtex, 10 f) as a pile yarn (α3) for loops; weaving the ground warp (α1), the ground weft (α2) and the pile yarn (α3) at a weft density of 46 per inch to form a woven fabric; and heat-treating the woven fabric at a temperature of 200° C. for 1 minute. The results are shown in Table 1. Incidentally, the peak thermal stresses and dry heat shrinkages of each of the ground warp, the ground weft and the pile yarn used are also shown in Table 1.

Thus obtained separable fastener member had a mass ratio of 40% of the ground warp, 26% of the ground weft, 34% of the pile yarn for loops, and had five fused (or intersected) points of the ground weft with the pile yarn between loops of the adjacent pile yarns in the lengthwise direction of the fastener member. The distance (L) of the pile yarn was 0.460 mm. The weft density was 54 per inch, the warp density was 170 per inch, the cover factors K1 and K2 were 31.6 and 13.5, respectively, and the ratio K1/K2 was 2.38. Moreover, the void space in a unit area defined by ground warps and ground wefts was 5 $\mu m^2$, and the pile drawing out strength was 1.1 kg per yarn.

The peel test between the obtained loop fastener member and a hook fastener member (manufactured by Kuraray Fastening Co., Ltd., A86900) revealed that loops were not drawn out even after 5000 repeated engagement-disengagement (in accordance with JIS L3416) and that the loop fastener member did not have fluff. Moreover, thus obtained separable fastener member was dyed in a conventional method with a disperse dye at 130° C. for 1 hour. The dyed separable fastener member did not have any hue difference and had a uniform appearance in hue, and also was not deformed.

Example 3

A hook fastener member was prepared by weaving in the same manner with Example 1 except that yarns shown in Table 1 were used as a ground warp, a ground weft (a binder fiber) and a pile yarn to form a woven fabric; heat-treating the woven fabric at a temperature of 190° C. for 1 minute; and cutting hook-forming loops of the pile yarn. In thus obtained hook fastener member, the distance (L) of the pile yarn was 0.553 mm. The weft density was 47 per inch, the warp density was 176 per inch, the cover factors K1 and K2 were 34.9 and 11.7, respectively, and the ratio K1/K2 was 2.97. Moreover, the void space in a unit area defined by ground warps and ground wefts was 15 $\mu m^2$, and the pile drawing out strength was 1.1 kg per yarn.

The peel test between the obtained hook fastener member and a loop fastener member (manufactured by Kuraray Fastening Co., Ltd., B27000) revealed that hooks were not dropped out even after 5000 repeated engagement-disengagement (in accordance with JIS L3416).

Example 4

A loop fastener member was prepared by weaving in the same manner with Example 2 except that yarns shown in Table 1 were used as a ground warp, a ground weft (a binder fiber) and a pile yarn to form a woven fabric; and heat-treating the woven fabric at a temperature of 195° C. for 1 minute. In thus obtained loop fastener member, the distance (L) of the pile yarn was 0.462 mm. The weft density was 54 per inch, the warp density was 170 per inch, the cover factors K1 and K2 were 31.6 and 13.5, respectively, and the ratio K1/K2 was 2.38. Moreover, the void space in a unit area defined by ground warps and ground wefts was 10 $\mu m^2$, and the pile drawing out strength was 1.0 kg per yarn.

The peel test between the obtained loop fastener member and a hook fastener member (manufactured by Kuraray Fastening Co., Ltd., A86900) revealed that loops were not drawn out even after 5000 repeated engagement-disengagement (in accordance with JIS L3416), and that the loop fastener member did not have fluff.

Example 5

A hook fastener member was prepared by weaving in the same manner with Example 1 except that yarns shown in Table 1 were used as a ground warp, a ground weft (a binder fiber) and a pile yarn to form a woven fabric; heat-treating the woven fabric at a temperature of 185° C. for 1 minute; and cutting hook-forming loops of the pile yarn. In thus obtained hook fastener member, the distance (L) of the pile yarn was 0.524 mm. The weft density was 47 per inch, the warp density was 170 per inch, the cover factors K1 and K2 were 35.8 and 11.8, respectively, and the ratio K1/K2 was 3.03. Moreover, the void space in a unit area defined by ground warps and ground wefts was 10 $\mu m^2$, and the pile drawing out strength was 1.2 kg per yarn.

The peel test between the obtained hook fastener member and a loop fastener member (manufactured by Kuraray Fastening Co., Ltd., B27000) revealed that hooks were not dropped out even after 5000 repeated engagement-disengagement (in accordance with JIS L3416).

Example 6

A loop fastener member was prepared in the same manner with Example 2 except for weaving yarns shown in Table 1 as a ground warp, a ground weft (a binder fiber) and a pile yarn to form a woven fabric and heat-treating the woven fabric at a temperature of 210° C. for 1 minute to anchor the pile yarn with the fused ground weft at three points between adjacent loops. In thus obtained loop fastener member, the distance (L) of the pile yarn was 0.424 mm. The weft density was 57 per inch, the warp density was 170 per inch, the cover factors K1 and K2 were 34.9 and 13.5, respectively, and the ratio K1/K2 was 2.59. Moreover, the void space in a unit area defined by ground warps and ground wefts was 5 $\mu m^2$, and the pile drawing out strength was 1.1 kg per yarn.

The peel test between the obtained loop fastener member and a hook fastener member (manufactured by Kuraray Fastening Co., Ltd., A86900) revealed that loops were not drawn out even after 5000 repeated engagement-disengagement (in accordance with JIS L3416), and that the loop fastener member did not have fluff.

Comparative Example 1

A hook fastener member was prepared by weaving the ground warp, the ground weft and the pile yarn which were same with Example 1 at a weft density of 38 per inch to form a woven fabric; heat-treating the woven fabric at a temperature of 185° C. for 1 minute; and cutting hook-forming loops of the pile yarn. In thus obtained hook fastener member, the distance (L) of the pile yarn was 0.621 mm. The weft density was 43 per inch, the warp density was 176 per inch, the cover factors K1 and K2 were 35.7 and 10.7, respectively, and the ratio K1/K2 was 3.32. Moreover, the void space in a unit area defined by ground warps and ground wefts was 180 $\mu m^2$, and the pile drawing out strength was 0.6 kg per yarn.

The peel test between the obtained hook fastener member and a loop fastener member (manufactured by Kuraray Fastening Co., Ltd., B27000) revealed that hooks were dropped out after 2000 repeated engagement-disengagement (in accordance with JIS L3416).

Comparative Example 2

A loop fastener member was prepared by the ground warp, the ground weft and the pile yarn which were same with Example 2 at a weft density of 44 per inch to form a woven fabric; and heat-treating the woven fabric at a temperature of 185° C. for 1 minute.

In thus obtained loop fastener member, the distance (L) of the pile yarn was 0.561 mm. The weft density was 48 per inch, the warp density was 169 per inch, the cover factors K1 and K2 were 30.6 and 12.1, respectively, and the ratio K1/K2 was 2.52. Moreover, an area of the void space in a unit area defined by a pair of ground warps and a pair of ground wefts both of which are adjacent to the pile yarn was 150 $\mu m^2$, and the pile drawing out strength was 0.5 kg per yarn.

The peel test between the obtained loop fastener member and a hook fastener member (manufactured by Kuraray Fastening Co., Ltd., A86900) revealed that the loop fastener member had shedding of loops and caused fluff after 2000 repeated engagement-disengagement (in accordance with JIS L3416).

Comparative Example 3

A hook fastener member was prepared by weaving in the same manner with Example 3 except that yarns shown in Table 1 were used as a ground warp, a ground weft (a binder fiber) and a pile yarn to form a woven fabric; heat-treating the woven fabric at a temperature of 190° C. for 1 minute; and cutting hook-forming loops of the pile yarn. In thus obtained hook fastener member, the distance (L) of the pile yarn was 0.722 m. The weft density was 47 per inch, the warp density was 176 per inch, the cover factors K1 and K2 were 35.2 and 8.3, respectively, and the ratio K1/K2 was 4.25. Moreover, the void space in a unit area defined by ground warps and ground wefts was 200 $\mu m^2$, and the pile drawing out strength was 0.8 kg per yarn.

The peel test between the obtained hook fastener member and a loop fastener member (manufactured by Kuraray Fastening Co., Ltd., B27000) revealed that hooks were dropped out after 2000 repeated engagement-disengagement (in accordance with JIS L3416).

Comparative Example 4

A loop fastener member was prepared by weaving in the same manner with Example 4 except that yarns shown in Table 1 were used as a ground warp, a ground weft (a binder fiber) and a pile yarn in the proportion of Table 1 to form a woven fabric; and heat-treating the woven fabric at a temperature of 200° C. for 1 minute. In thus obtained hook fastener member, the distance (L) of the pile yarn was 0.640 mm. The weft density was 55 per inch, the warp density was 170 per inch, the cover factors K1 and K2 were 32.2 and 9.6, respectively, and the ratio K1/K2 was 3.35. Moreover, the void space in a unit area defined by ground warps and ground wefts was 170 $\mu m^2$, and the pile drawing out strength was 0.7 kg per yarn.

The peel test between the obtained loop fastener member and a hook fastener member (manufactured by Kuraray Fastening Co., Ltd., A86900) revealed that the loop fastener member had shedding of loops and caused fluff after 2000 repeated engagement-disengagement (in accordance with JIS L3416).

Comparative Example 5

Weaving step was attempted for making a separable fastener member having the distance (L) of the pile yarn of 0.28 mm in the same manner with Comparative Example 4 except that a ground weft (a binder fiber) having a fineness of 110 dtex was used instead of the ground weft of Comparative Example 4. However, the weaving step failed because the base fabric was oversupplied at a beating-up part (reed part).

Comparative Example 6

A hook fastener member was prepared by weaving in the same manner with Example 5 except that a binder fiber (a sheath-core structure polyester fiber, the sheath component: a copolymerized polyethylene terephthalate modified with 55% by mole of isophthalic acid, the core component: a polyethylene terephthalate, the core/sheath ratio (by mass): 25/75, 334 dtex, 96 f) having physical properties shown in Table 1 was used as a ground weft instead of the binder fiber of Example 5; heat-treating the woven fabric at a temperature of 190° C. for 1 minute; and cutting hook-forming loops of the pile yarn. In thus obtained hook fastener member, the distance (L) of the pile yarn was 0.598 mm. The weft density was 46 per inch, the warp density was 165 per inch, the cover factors K1 and K2 were 33.1, and 11.2, respectively, and the ratio K1/K2 was 2.95. Moreover, the void space in a unit area defined by ground warps and ground wefts was 150 $\mu m^2$, and the pile drawing out strength was 0.7 kg per yarn.

The peel test between the obtained hook fastener member and a loop fastener member (manufactured by Kuraray Fastening Co., Ltd., B27000) revealed that hooks were dropped out even after 2000 repeated engagement-disengagement (in accordance with JIS L3416).

Comparative Example 7

A hook fastener member was prepared by weaving in the same manner with Example 6 except that a binder fiber (a sheath-core structure polyester fiber, the sheath component: a copolymerized polyethylene terephthalate modified with 55% by mole of isophthalic acid, the core component: a polyethylene terephthalate, the core/sheath ratio (by mass): 25/75, 334 dtex, 96 f) having physical properties shown in Table 1 was used as a ground weft instead of the binder fiber of Example 6 to form a woven fabric; and heat-treating the woven fabric at a temperature of 195° C. for 1 minute. In thus obtained loop fastener member, the distance (L) of the pile yarn was 0.545 m. The weft density was 52 per inch, the warp density was 160 per inch, the cover factors K1 and K2 were 29.9, and 12.8, respectively, and the ratio K1/K2 was 2.34. Moreover, the void space in a unit area defined by ground warps and ground wefts was 130 $\mu m^2$, and the pile drawing out strength was 0.6 kg per yarn.

The peel test between the obtained loop fastener member and a hook fastener member (manufactured by Kuraray Fastening Co., Ltd., A86900) revealed that the loop fastener member had loop slip-out and caused fluff after 2000 repeated engagement-disengagement (in accordance with JIS L3416).

[Table 1]

TABLE 1

| | Warp (α1) (%) | Weft (α2) (%) | Pile yarn (α3) (%) | Distance (L) of pile yarn (mm) | K1 | K2 | K1/K2 | Void space ($\mu m^2$) | Pile drawing out strength (kg/yarn) |
|---|---|---|---|---|---|---|---|---|---|
| Ex. 1 | 38 | 27 | 35 | 0.523 | 35.8 | 11.8 | 3.03 | 10 | 1.2 |
| Ex. 2 | 40 | 26 | 34 | 0.460 | 31.6 | 13.5 | 2.38 | 5 | 1.1 |
| Ex. 3 | 38 | 27 | 35 | 0.553 | 34.9 | 11.7 | 2.97 | 15 | 1.1 |
| Ex. 4 | 40 | 26 | 34 | 0.462 | 31.6 | 13.5 | 2.38 | 10 | 1.0 |
| Ex. 5 | 38 | 27 | 35 | 0.524 | 35.8 | 11.8 | 3.03 | 10 | 1.2 |
| Ex. 6 | 39 | 24 | 37 | 0.424 | 34.9 | 13.5 | 2.59 | 5 | 1.1 |
| Com. Ex. 1 | 38 | 27 | 35 | 0.621 | 35.7 | 10.7 | 3.32 | 180 | 0.6 |
| Com. Ex. 2 | 40 | 26 | 34 | 0.561 | 30.6 | 12.1 | 2.52 | 150 | 0.5 |
| Com. Ex. 3 | 45 | 19 | 43 | 0.722 | 35.2 | 8.3 | 4.25 | 200 | 0.8 |
| Com. Ex. 4 | 50 | 16 | 34 | 0.640 | 32.2 | 9.6 | 3.35 | 170 | 0.7 |
| Com. Ex. 5 | | | | Unable to be woven | | | | | |
| Com. Ex. 6 | 38 | 27 | 35 | 0.598 | 33.1 | 11.2 | 2.95 | 150 | 0.7 |
| Com. Ex. 7 | 40 | 26 | 34 | 0.545 | 29.9 | 12.8 | 2.34 | 130 | 0.6 |

TABLE 1-continued

| | Warp | | Weft | | | Pile yarn | | |
|---|---|---|---|---|---|---|---|---|
| | Peak thermal stress (cN/dtex) | Dry heat shrinkage (%) | Core/Sheath ratio (by mass) | Peak thermal stress (cN/dtex) | Dry heat shrinkage (%) | Peak thermal stress (cN/dtex) | Dry heat shrinkage (%) | Durability |
| Ex. 1 | 0.08 | 6.4 | 75/25 | 0.32 | 15.1 | 0.15 | 17.2 | Good |
| Ex. 2 | 0.09 | 6.3 | 70/30 | 0.31 | 20.0 | 0.11 | 18.4 | Good |
| Ex. 3 | 0.10 | 10.2 | 50/50 | 0.28 | 17.3 | 0.15 | 17.1 | Good |
| Ex. 4 | 0.10 | 10.3 | 50/50 | 0.27 | 18.1 | 0.11 | 18.5 | Good |
| Ex. 5 | 0.08 | 6.6 | 30/70 | 0.23 | 25.4 | 0.15 | 17.1 | Good |
| Ex. 6 | 0.08 | 6.3 | 30/70 | 0.24 | 28.2 | 0.11 | 18.5 | Good |
| Com. Ex. 1 | 0.08 | 6.4 | 75/25 | 0.32 | 15.1 | 0.15 | 17.2 | Bad |
| Com. Ex. 2 | 0.08 | 6.3 | 70/30 | 0.31 | 20.0 | 0.11 | 18.4 | Bad |
| Com. Ex. 3 | 0.10 | 10.2 | 50/50 | 0.28 | 17.3 | 0.15 | 17.2 | Bad |
| Com. Ex. 4 | 0.10 | 10.3 | 50/50 | 0.27 | 18.1 | 0.11 | 18.4 | Bad |
| Com. Ex. 5 | | | | Unable to be woven | | | | |
| Com. Ex. 6 | 0.08 | 6.2 | 25/75 | 0.13 | 32.2 | 0.15 | 17.2 | Bad |
| Com. Ex. 7 | 0.08 | 6.4 | 25/75 | 0.12 | 35.0 | 0.11 | 18.4 | Bad |

As apparent from the result of Table 1, the separable fastener members of Examples were good in appearance, and excellent in durability against the peel test. On the contrary, in Comparative Example 5, the separable fastener member was unable to be woven, and the separable fastener members of other Comparative Examples were deteriorated in durability.

The invention claimed is:

1. A separable fastener member without a back-coated layer, which comprises (α1) a ground warp, (α2) a ground weft of a binder fiber, and (α3) a pile yarn, wherein the pile yarn (α3) is anchored by the fused binder fiber, and the separable fastener member fulfills the following conditions (i) to (vi):

(i) each of the ground warp (α1), the ground weft (α2) and the pile yarn (α3) comprises a polyester fiber, and the proportion (mass ratio) of the ground warp (α1) relative to the ground weft (α2) (α1/α2) is 50/50 to 70/30, and the proportion (mass ratio) of the total amount of the ground warp (α1) and the ground weft (α2) relative to the pile yarn (α3) [(α1+α2)/α3] is 80/20 to 60/40, (ii) the distance (L) between adjacent anchored points of the pile yarn (α3) is 0.3 to 0.7 mm, (iii) the void space in a unit area defined by a pair of ground warps (α1) and a pair of ground wefts (α2) both of which are adjacent to the pile yarn (α3) is 0 to 30 $\mu m^2$, and the pile drawing out strength is not less than 1 kg per yarn, and (iv) the cover factor (K1) of the ground warp (α1) and the cover factor (K2) of the ground weft (α2) fulfill the following formulae, $$28 \leqq K1 \leqq 38$$

$$10 \leqq K2 \leqq 18$$

$$1.56 \leqq (K1/K2) \leqq 3.8,$$

(v) the ground weft (α2) is a multifilament yarn having yarn fineness of 150 to 400 dtex and comprising 30 to 150 of sheath-core structure conjugated fibers having single fiber fineness of 2 to 10 dtex and comprising a binder resin as the sheath component, (vi) each of the ground warp (α1), the ground weft (α2) and the pile yarn (α3) satisfies the following conditions Peak thermal stress of α1≧0.07 cN/dtex Peak thermal stress of α2≧0.20 cN/dtex Peak thermal stress of α3≧0.10 cN/dtex;

(vii) and wherein each of the ground warp (α1), the ground weft (α2) and the pile yarn (α3) satisfies the following conditions 4%≦Dry heat shrinkage of α1 at 180° C.≦20%

13% Dry heat shrinkage of α2 at 180° C.≦30%

10% Dry heat shrinkage of α3 at 180° C.≦30%.

2. A separable fastener member according to claim 1, wherein each of the ground warp (α1), the ground weft (α2) and the pile yarn (α3) comprises an aromatic polyester fiber, and the binder fiber constituting the ground weft (α2) comprises an amorphous polyester fiber.

3. A separable fastener member according to claim 1, wherein the binder fiber constituting the ground weft (α2) is a sheath-core structure conjugated fiber which comprises a polyester resin having a melting point of not lower than 160° C. as the core component and an amorphous polyester resin as the sheath component in a core/sheath ratio (mass ratio) of 75/25 to 30/70.

4. An object comprising on at least one surface thereof the separable fastener member of claim 1.

5. An object comprising on at least one surface thereof the separable fastener member of claim 2.

6. An object comprising on at least one surface thereof the separable fastener member of claim 3.

7. A separable fastener member according to claim 1, wherein (α2) the ground weft consists essentially of a binder fiber.

8. A separable fastener member according to claim 1, wherein (α2) the ground weft consists of a binder fiber.

9. A process for producing a separable fastener member recited in claim 1, which comprises providing a woven fabric formed from a ground warp (α1), a ground weft (α2) and a pile yarn (α3), and heat-treating the woven fabric to fuse the ground weft (α2) containing a binder fiber and to anchor the pile yarn (α3) in the woven fabric, wherein each of the ground warp (α1), the ground weft (α2) and the pile yarn (α3) satisfies the following conditions (1) and (2), 1) Peak thermal stress of α1≧0.07 cN/dtex
Peak thermal stress of α2≧0.20 cN/dtex
Peak thermal stress of α3≧0.10 cN/dtex (2) 4%≦Dry heat shrinkage of α1 at 180° C. 5≦20%
13%≦Dry heat shrinkage of α2 at 180° C.≦30%
10%≦Dry heat shrinkage of α3 at 180° C.≦30%.

10. A production process according to claim 9, wherein the ratio of the peak thermal stress of the ground warp (α1) relative to the ground weft (α2) is 1/0.5 to 1/5, the ratio of the peak thermal stress of the pile yarn ($\alpha 3$) relative to the ground weft ($\alpha 2$) is 1/0.5 to 1/4, the ratio of the dry heat shrinkage of the ground warp ($\alpha 1$) relative to the ground weft ($\alpha 2$) at 180° C. is 1/0.5 to 1/7, and the ratio of the dry heat shrinkage at 180° C. of the pile yarn ($\alpha 3$) relative to the ground weft ($\alpha 2$) is 1/0.5 to 1/5.

* * * * *